US005892809A

United States Patent [19]

Wittry

[11] Patent Number: 5,892,809

[45] Date of Patent: Apr. 6, 1999

[54] SIMPLIFIED SYSTEM FOR LOCAL EXCITATION BY MONOCHROMATIC X-RAYS

[76] Inventor: David B. Wittry, 1036 S. Madison Ave., Pasadena, Calif. 91106-4365

[21] Appl. No.: 149,690

[22] Filed: Sep. 8, 1998

Related U.S. Application Data

[60] Provisional application No. 60/058,409, Sep. 10, 1997.

[51] Int. Cl. [6] ..... G21K 1/06

[52] U.S. Cl. ..... 378/85; 378/45

[58] Field of Search ..... 378/85, 82, 45

[56] References Cited

U.S. PATENT DOCUMENTS 4,599,741 7/1986 Wittry ..... 378/85

4,752,945 6/1988 Jenkens et al. ..... 378/85

5,173,930 12/1992 Hoover ..... 378/85

*Primary Examiner*—Craig E. Church

[57] ABSTRACT

A system for local excitation by monochromatic X-rays having a plurality of x-ray sources and a plurality of focussing diffractors to selectively monochromatize X-rays and focus them on a particular region of a sample to be analyzed. The X-ray source for each diffractor is selected from a plurality of closely-spaced sources by displacement of the focal spot of an electron beam that produces the X-rays. Each diffractor is prealigned to focus X-rays generated by the electron beam onto a common region of the sample. Each diffractor comprises a toroidally shaped crystal structure, which, along with the appropriate source and the common region of the specimen satisfies the Johann or Johansson geometric conditions within a plurality of planes containing both the source of X-rays and the focused X-ray image. Application of the system for local excitation to X-ray fluorescence analysis is described.

20 Claims, 5 Drawing Sheets

FIG.1
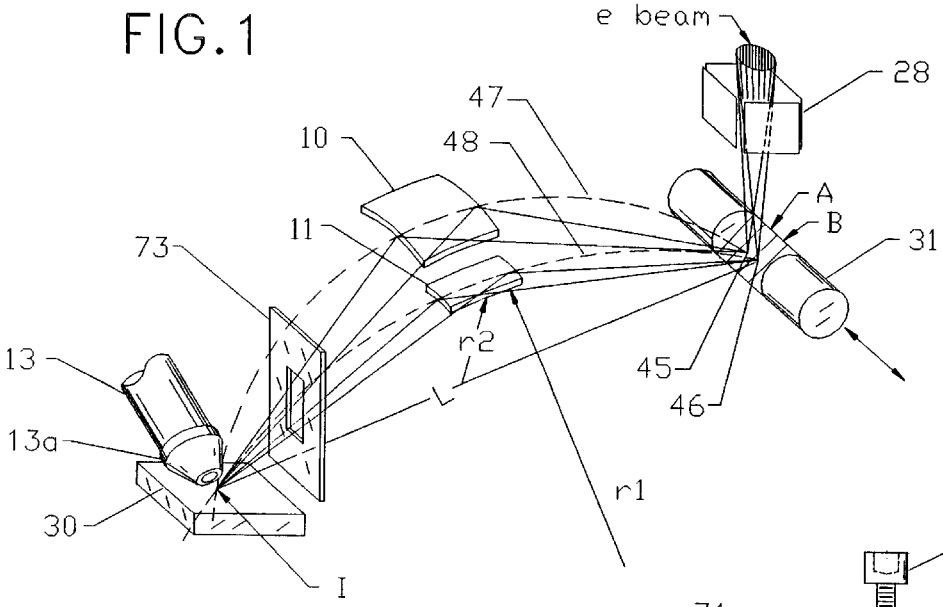
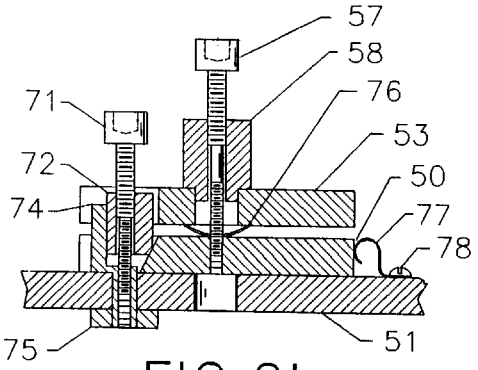
FIG.2b
FIG.2a
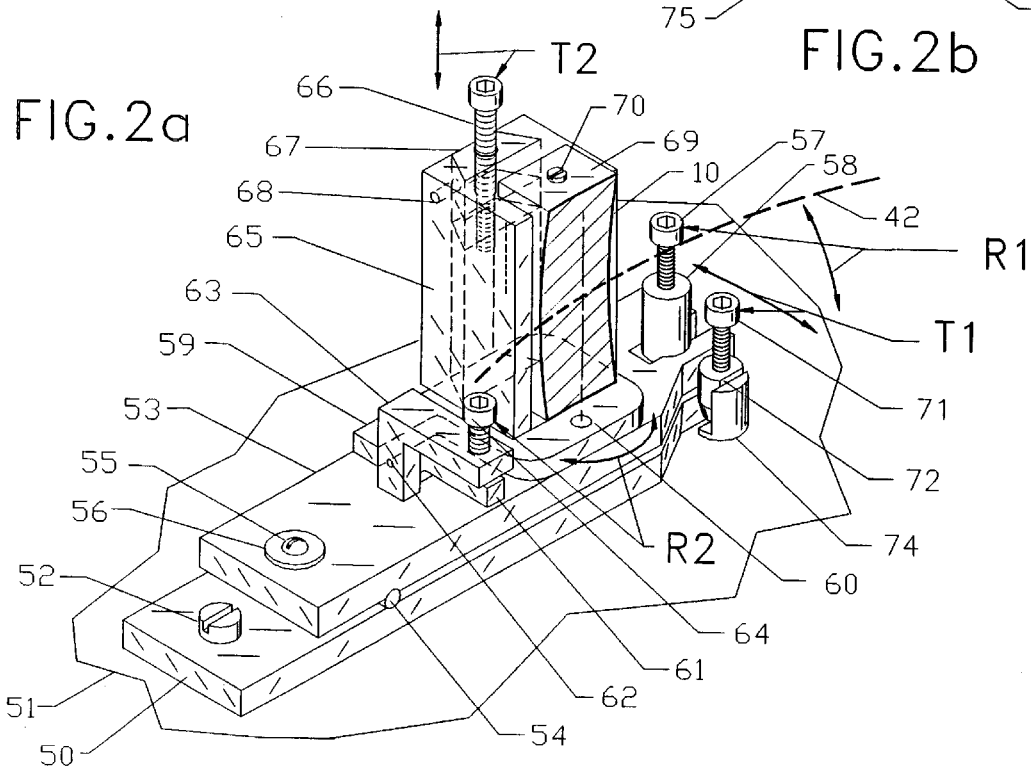

SECTION A-A

FIG.5 EXAMPLES OF PHOTON ENERGIES AND DIFFRACTORS FOR BRAGG ANGLES FROM 13 TO 46 DEGREES

| CASE | ENERGY KeV | TARGET ELEMENT | LINE | WAVELENGTH (A) | CRYSTAL 2d (A)* | $\theta_B$ deg. | FOCAL CIRCLE R | DIFFRACTOR w mm | DIFFRACTOR h mm |
|---|---|---|---|---|---|---|---|---|---|
| 1 | 0.928 | Cu | $L_{\alpha 1}$ | 13.336 | 26.12 (a) | 30.70 | 102.51 mm | 8.1 | 40 |
| 2 | 1.487 | Al | $K_{\alpha 1}$ | 8.3393 | 26.12 (a) | 18.61 | 148.79 | | |
| 3 | " | " | " | " | 19.88 (b) | 24.79 | 118.21 | | |
| 4 | 2.166 | Nb | $L_{\alpha 1}$ | 5.7243 | 8.808 (c) | 40.53 | 91.11 | | |
| 5 | 2.295 | Mo | $L_{\alpha 1}$ | 5.4066 | 8.808 (c) | 37.86 | 92.87 | | |
| 6 | " | " | " | " | 8.726 (d) | 38.29 | 92.53 | 7.3 | 53 |
| 7 | 4.510 | Ti | $K_{\alpha 1}$ | 2.7485 | 8.808 (c) | 18.18 | 153.27 | | |
| 8 | " | " | " | " | 8.726 (d) | 16.55 | 164.80 | | |
| 9 | " | " | " | " | 6.643 (f) | 24.44 | 119.47 | | |
| 10 | " | " | " | " | 6.271 (g) | 25.99 | 114.24 | | |
| 11 | " | " | " | " | 3.986 (h) | 43.59 | 90.11 | | |
| 12 | " | " | " | " | 3.845 (i) | 45.62 | 90.02 | 7.2 | 60 |
| 13 | 8.047 | Cu | $K_{\alpha 1}$ | 1.5406 | 6.643 (f) | 13.41 | 199.47 | | |
| 14 | " | " | " | " | 6.271 (g) | 14.22 | 188.98 | | |
| 15 | " | " | " | " | 3.986 (h) | 22.74 | 126.23 | 10 | 28 |
| 16 | " | " | " | " | 2.719 (j) | 34.51 | 96.39 | | |
| 17 | " | " | " | " | 2.491 (k) | 38.20 | 92.60 | | |
| 18 | 16.614 | Nb | $K_{\alpha 1}$ | 0.7462 | 2.491 (k) | 17.43 | 157.46 | | |
| 19 | 17.478 | Mo | $K_{\alpha 1}$ | 0.7093 | 2.491 (k) | 16.54 | 164.89 | 13 | 20 |
| 20 | " | " | " | " | 2.024 (l) | 20.51 | 137.13 | | |

* 2d spacings of useful crystals:

| | | | | | |
|---|---|---|---|---|---|
| (a) TAP (001) | 25.75 | (e) Quartz $(10\bar{1}\bar{1})$ | 6.7153 | (i) Si (220) | 3.845 |
| (b) Mica (002) | 19.88 | (f) Mica (006) | 6.643 | (j) Si (400) | 2.719 |
| (c) EDdT (020) | 8.808 | (g) Si (111) | 6.271 | (k) Mica (00 16) | 2.491 |
| (d) PET (002) | 8.726 | (h) Mica (00 10) | 3.986 | (l) Quartz $(22\bar{4}3)$ | 2.024 |

SIMPLIFIED SYSTEM FOR LOCAL EXCITATION BY MONOCHROMATIC X-RAYS

This application is based on provisional application Ser. No. 60/058,409 which was filed Sep. 10, 1997 and bears the same title.

BACKGROUND—FIELD OF THE INVENTION

This invention relates to instruments for microanalysis in which a small region at the surface of a specimen is bombarded with monochromatic x-rays. Measurement of the scattered or emitted x-rays or charged particles is used to characterize the material making up the specimen.

BACKGROUND—PRIOR ART

It is well known that microanalysis can be performed by bombarding a small region with a focused beam of charged particles or electromagnetic radiation. At the present time, most commercially available instruments for accomplishing this in the laboratory use electron or ion beams for excitation because of the ease with which charged particles can be focused. The use of X-rays has been limited up to now because of the difficulties of focusing X-rays. However, some success has been achieved in localizing the analysis in instruments for X-ray fluorescence analysis by the use of apertures for the X-ray beam or by using total reflection inside a capillary or a monolithic polycapillary optic. Unfortunately these approaches do not provide monochromatic radiation. This results in the detection limits in microanalysis by X-ray fluorescence being degraded by the presence of background due to scattering by the specimen of the X-ray continuum from the source.

The use of doubly curved X-ray diffractors has been investigated for a long time as a way to obtain focussing of a monochromatic X-ray beam for microanalysis. A suitable geometry for point-to-point focussing ideally involves rotating either the Johann or the Johansson geometries about a line joining the source and image. In the Johann geometry, a curved crystal has lattice planes curved to a radius 2R and the source and its image lie on a focal circle of radius R that is tangent to the crystal's surface. In the Johansson geometry, the crystal planes are similarly shaped but the crystal surface is curved to a radius of R. Some of the other approaches that have been proposed have been referenced in Wittry's U.S. Pat. No. 4,599,741 issued in 1986, for example patents by Berreman (1958), Hammond (1973), Furnas (1975), and Carrol (1980). A paper describing the focusing of monochromatic radiation was presented by P. S. Ong at the 29th Annual conference of the Microbeam Analysis Society in 1974. This paper described an experimental set-up for X-ray fluorescence analysis that had been constructed using a singly curved diffractor and another one under construction that would use a doubly curved diffractor. Both diffractors employed the Johansson geometry in the plane of the focal circle but satisfactory operation of the doubly curved diffractor was never reported subsequently.

Practical development of point-focusing diffractors for obtaining a small spot of monochromatic X-radiation was accomplished by Larson and Palmberg as described in U. S. Pat. Nos. 5,315,113 and 5,444,242. Their diffractor was used for aluminum $K_\alpha$ radiation in a commercial instrument for ESCA. Because of the relatively long wavelength of radiation needed for ESCA, it was possible to use a Bragg angle close to 90 degrees. The large Bragg angle facilitates implementation of the point focussing diffractor which was made of quartz.

For X-ray fluorescence analysis, the use of Bragg angles close to 90 degrees is not usually possible. In this application, the desired radiation has sufficiently small wavelengths that no commonly available crystal materials yield high diffraction efficiency at large Bragg angles. Also, for this application, it appeared that the Johansson geometry would be needed in the plane of the focal circle in order to obtain a sufficiently high collection solid angle. As a result, much of the work on point-focusing diffractors during the past 10 years was concentrated on trying to construct diffractors that had this geometry and also subtended a large solid angle at the source. The difficulties of achieving this configuration greatly inhibited the development of practical diffractors for X-ray microprobe fluorescence analysis.

A different approach which was used recently by Chen and Wittry led to a successful demonstration of microprobe X-ray fluorescence analysis as described in the Journal of Applied Physics vol. 84, pp 1064–1073 (1998). In this approach, the emphasis was on utilizing a diffractor that was more accurately made and aligned, rather than one that had the largest possible collection solid angle. It was found that a small toroidally curved diffractor based on the Johann geometry when used with a 3 watt microfocus X-ray source provided enough intensity in a focused beam of Cu $K_\alpha$ radiation for X-ray fluorescence analysis.

The successful results were due to a number of factors. First, work by Wittry and his coworkers provided a theoretical basis for understanding the precision required in the fabrication and alignment of curved diffractors (Journal of Applied Physics: vol. 67, pp 1633–38, 1990; vol. 71, pp 564–8, 1992; vol. 73, pp 601–07, 1993; vol. 74, pp 2999–3008, 1993). Second, detection of the fluorescence-excited radiation by an energy dispersive spectrometer with its high collection solid angle reduced the X-ray microprobe intensity required compared with the intensity required if a wavelength dispersive spectrometer were used. Finally, comparison data for X-ray fluorescence analysis obtained with an X-ray microprobe based on the use of single and polycapillary optics were available to indicate that the diffractor was capable of providing superior performance than these other methods.

The present invention is an improvement and simplification over the Wittry U.S. Pat. No. 4,599,741. As in U.S. Pat. No. 4,599,741, several diffractors are provided. But selection of one of the multiple diffractors can be accomplished without the need for the diffractors to move. This results in simpler and more reliable operation.

OBJECTIVES AND ADVANTAGES OF THE PRESENT INVENTION

The objectives of the present invention are to provide a simplified system whereby microanalysis with high sensitivity and low detection limits for impurities can be performed in the laboratory. These characteristics are obtained by the used of monochromatic x-rays from characteristic x-ray lines which can be selected to optimize the photon energy for excitation of particular ranges of energy levels of elements in the specimen. In contrast to similar systems that have previously been described, the present system is more compact, less expensive to manufacture, and easier to operate.

DESCRIPTION OF THE FIGURES

FIG. 1 is a schematic diagram illustrating the basic principle of the present invention.

FIG. 2*a* and 2*b* are detailed views showing the alignment and mounting arrangement for one the diffractors used in the invention.

FIG. 5 shows values of some of the parameters of typical diffractors used in the instrument for microprobe X-ray fluorescence.

BRIEF DESCRIPTION OF THE INVENTION

Figure 4:
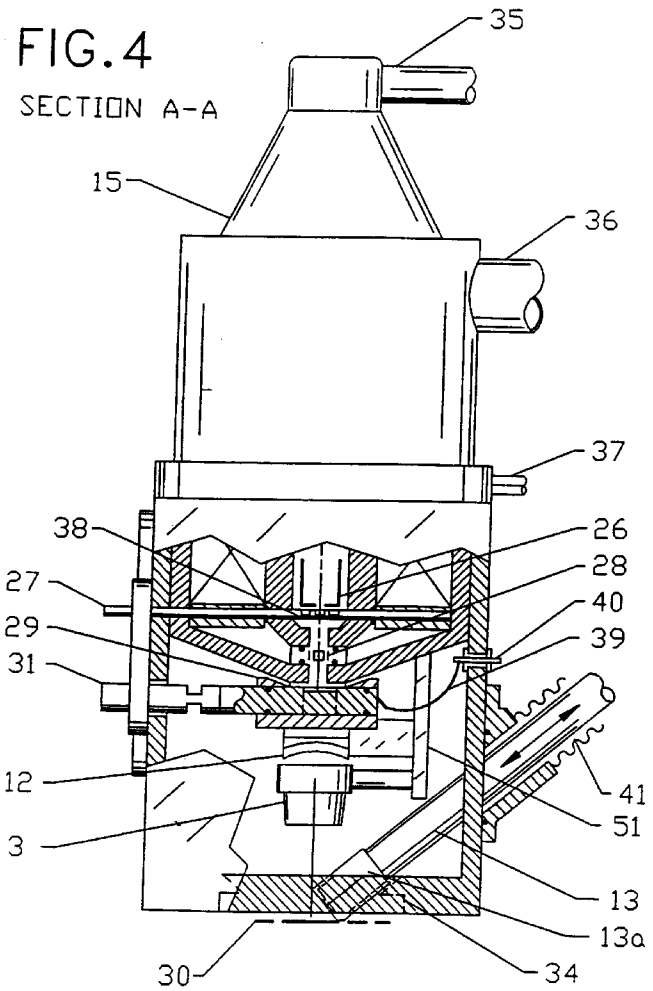
FIG. 4 shows a side view of the instrument for microprobe X-ray fluorescence.

FIG. 1 shows the basic principle of the present invention. X-ray diffractors, e.g. 10 and 11 are configured with toroidally curved diffracting planes of radius r1 in the plane of the focal circle (e.g. 47, 48) and r2 in a plane perpendicular to the focal circle and passing through the diffractor's midpoint. The radii of curvature r1 and r2 are given in terms of the Bragg angle $\theta_B$ and the distance from source to image L by the following equations:

$$r1=(L/2)/(\cos\theta_B\times\sin\theta_B)$$

$$r2=(L/2)\times\tan\theta_B$$

In the plane of the focal circle the diffractors may have the Johann geometry, the Johansson geometry or a stepped approximation to the Johansson geometry (re: U.S. Pat. No. 5,127,028). Each diffractor has the same value of L. While only two diffractors are shown for illustration, it is clear that three or more diffractors could also be used.

The diffractors focus radiation from a point source, eg. 45 or 46, to a point image at the surface of a specimen 30. Other X-rays from the source that are not diffracted, i.e. X-rays that are scattered or X-rays traveling directly from the source are prevented from striking the specimen by shield 73. X-rays excited in the specimen 30 by the focused monochromatic X-ray beam are detected by an energy dispersive detector 13. This detector is provided with a conical collimator 13*a* so that it receives secondary X-rays from only a small region near the point of impact of the primary X-rays. While an EDS X-ray detector is one of the most useful detectors, it will be appreciated that other detectors, e.g. wavelength dispersive X-ray spectrometers or spectrometers for X-ray photoelectrons or Auger electrons could also be used.

The focused electron beam, which is used to form the x-ray source by bombardment of a suitable target, can be moved by electrostatic deflection plates 28 to strike targets of different material, e.g. material A on the surface of which point 45 is located or material B on the surface of which point 46 is located. The movement of the electron beam could alternatively be produced by electromagnetic deflection. In addition, selection of a target for the electron beam can be done by translation of the target holder 31.

It should be noted that the use of a two axis deflection system indicated by the four deflection plates 28 shown in FIG. 1 also has two other uses. First, by deflection of the beam in a raster fashion and using a suitable detector for backscattered electrons, it is possible to obtain an indication of the electron beam spot size and to use this information as an aid in adjusting the electron lenses. Second, if a hole or a Faraday cage (not shown in FIG. 1) is incorporated in the target holder and a deflection perpendicular to the deflection used to select the target material is used to deflect the beam into this hole, the X-ray source can be rapidly cut off. This feature can be useful for increasing the allowable counting rate when semiconductor detectors are used for energy dispersive x-ray spectrometry as shown by Jaklevic, Goulding and Landis.

Diffractors 10 and 11 are provided with suitable alignment means so that the image of points corresponding to source points 45 and 46 coincide at the specimen at point I. It will be noted that after initial alignment, the diffractors remain in a fixed position. This yields the same result of changing the energy of the monochromatic radiation as in the Wittry U.S. Pat. No. 4,599,741 without the complication of physically moving the diffractors.

DETAILED DESCRIPTION OF THE INVENTION

It can be appreciated that a critical feature of the present invention is a means for precise alignment of the diffractors that takes up very little space. An example of such an alignment means is shown in FIG. 2*a* and FIG. 2*b*. Each diffractor is mounted on a separate diffractor mounting plate 50 that is rotatably affixed to the common mounting plate 51 by a shoulder screw 52. A secondary mounting plate 53 has a groove in it containing a precision ground cylindrical rod 54 which also rests in a mating groove in plate 50. Plate 53 is held against the cylindrical rod 54 by a screw 55 and Belleville washer 56 at one end and at the other end by a differential screw 57 and nut 58 which is constrained against rotation by a slot in plate 53. A spring washer 76 (shown in FIG. 2*b* but not shown in FIG. 2*a*) lies between plate 50 and plate 53 on differential screw 57. Adjustment of screw 57 tilts plate 53 about an axis passing through the axis of the rod 54. This rotation is designated as R1.

A tertiary mounting plate 59 is attached to the secondary plate 53 by a shoulder pin 60 which is press-fitted into plate 53. The axis of pin 60 is positioned so that it is tangent to the surface of the diffractor 10 at its midpoint. The tertiary mounting plate 59 can be rotated about pin 60 by a right angle lever 61 which is rotatably moveable about pin 62 in bracket 63. Screw 64 threaded into bracket 63 presses on one end of lever 61 to cause plate 59 to rotate about a pivot pin 62 mounted on bracket 63. The dimensions of the lever 61 and plate 59 and the pitch of screw 64 are preferably chosen so that about 10 turns of screw 64 rotates plate 69 about one degree or less. This rotation is designated as R2.

Plate 59 has a right angle projection with accurately machined parallel sides that serve as guideways (refer to vertical dashed lines in FIG. 2*a*). The diffractor stage 65 has a channel which matches the guideways and can be moved along them by a differential screw 66 threaded into the projection on plate 59 at the screw's outer end and threaded with different pitch into a plug 67 held in place by set screw 68. By the use of a different pitch on each end of the differential screw, small translations of the diffractor stage can be made. This translation is designated as T2.

Finally, the diffractor, e.g. 10, is mounted on a substrate 69 which is held in a rectangular channel in the stage 65 by screw 70.

An effective translation of the diffractor parallel to the plate 51 is obtained by a differential screw 71 which moves a nut 72 having a beveled edge that pushes against a beveled portion of the plate 50 and rotates it about the axis of the shoulder screw 55. The details are shown in FIG. 2*b*. This Figure shows a section through the adjusting screws 57 and 71 perpendicular to plate 50. As seen in this view and in FIG. 2*a*, a bracket 74 attached to plate 51 by a mounting nut 75 prevents rotation of the nut 72. Bracket 74 has an internal thread to receive one end of differential screw 71. Differential screw 71 has a coarser thread near the head than on the end opposite the head, for example 40 threads/in vs 44 threads/in (or 48 threads/in). Thus, one revolution of the screw 71 moves the nut 72 a distance equal to the difference between the pitch of the two threads (note that differential screw 57 moves nut 58 with high sensitivity in a similar way). As screw 71 is turned, contact between nut 72 and the beveled portion of plate 50 is maintained by leaf spring 77 held by screw 78. The effective translation produced by screw 71 is designated as T1.

In summary, the diffractor can be adjusted by two rotations R1 and R2 and by two translations T1 and T2. The other two degrees of freedom of the diffractor are preset by tooling that is used during the fabrication of the diffractor and its substrate. It should be noted that the four adjustments are provided with appropriate leaf springs or wire springs to maintain the contact of the moving parts although all springs may not be shown. Also, all of the adjustments can be made from one side of the diffractor, an important consideration when multiple diffractors are employed with close spacing relative to one another. In addition, it is clear that if multiple diffractors are used that are all mounted on a common mounting plate, preliminary alignment can be done in a separate fixture with the use of an optical or x-ray beam.

Figure 3:
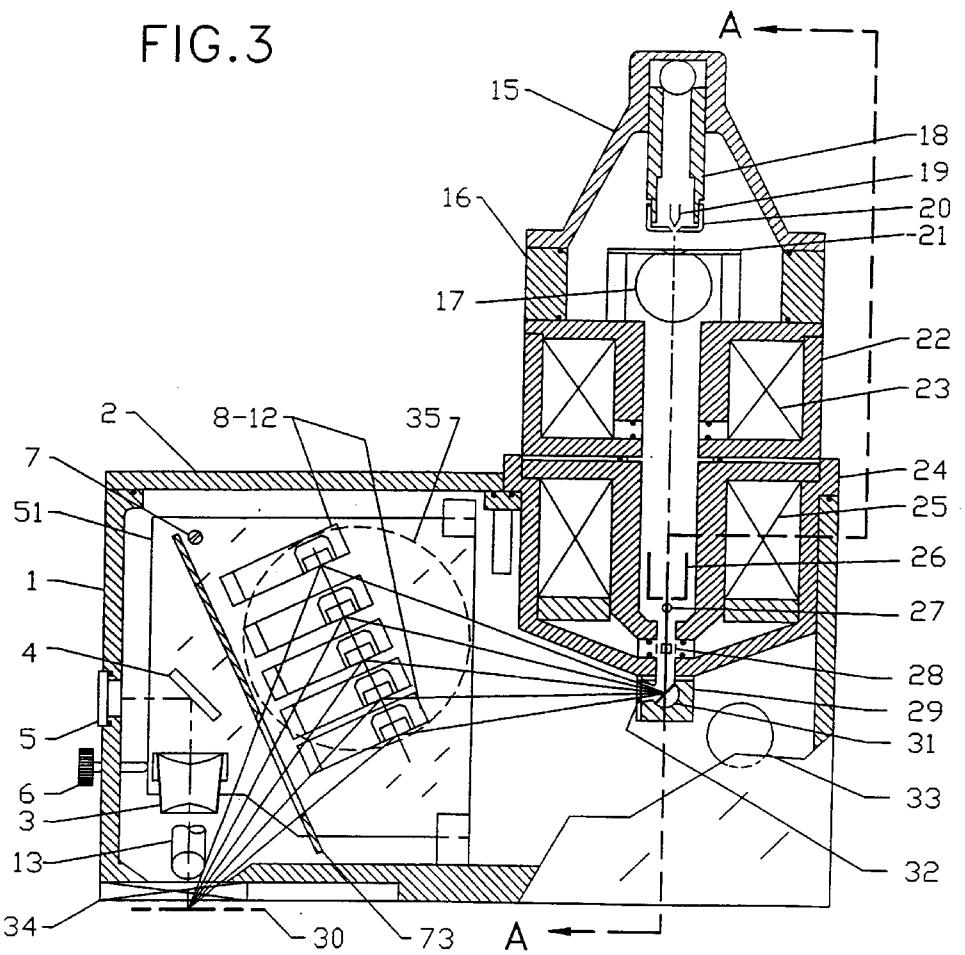
FIG. 3 shows a front view of one form of an instrument for microprobe X-ray fluorescence based on the invention.

Attention is now directed to FIG. 3 which shows a front view of an instrument for X-ray fluorescence analysis that utilizes the diffractors. This instrument consists of a housing 1 containing a diffractor common mounting plate 51 and a cover plate 2 to provide access for assembly. A specimen viewing system is provided which includes an objective lens 3, mirror 4, and window 5. Objective lens 3 and mirror 4 are attached to plate 51 while window 5 is in the wall of housing 2. A TV camera or a digital camera (not shown) would be located outside the housing in line with the axis of the window. An adjusting screw 6 provides for rotation of the diffractor common mounting plate 51 about the axis of a shoulder screw 7. Diffractor assemblies 8–12 are mounted on plate 51 with the common focal point of the different diffractors directed at specimen 30. Shield 73 prevents scattered X-rays or X-rays not diffracted from one of the diffractors from striking the specimen.

While five X-ray diffractors are shown in FIG. 3 it is clear that a different number could be used. Typically only three diffractors would be needed to allow coverage of all elements in the periodic table above sodium. The use of more than three diffractors makes it possible to improve the detection limits for groups of elements in selected regions of the periodic table including elements below sodium in atomic number. Examples of the diffractors will be discussed in conjunction with FIG. 5.

The X-rays that are focussed by the point-focusing diffractors are produced by bombardment by a focused electron beam of a selected target from a group of targets that are mounted on target holder 31. The focused electron beam is produced by a beam column assembly consisting of the following components: an electron gun housing 15, gun spacer 16 containing pumping port 17, insulator 18, cathode assembly 19, wehnelt cylinder 20, anode 21, magnetic condenser lens 22, condenser lens coil 23, objective lens 24, objective lens coil 25, column liner 26, aperture rod 27, and deflection plate (or coil) assembly 28. The focused beam from the objective lens passes into a target holder block 29 which contains target assembly 31 and has provision for mounting an ultrathin X-ray window or removable X-ray window 32 on the side facing the diffractors.

The electron beam column should be designed for electron accelerating voltages of 30 to 50 kV in order to obtain adequate excitation of characteristic lines whose critical excitation potential is as high as 20 kV. In practice, 40 kV would represent a reasonable compromise between cost and performance for an instrument used in X-ray fluorescence analysis.

While the electron beam column is shown with two magnetic lenses, it is clear that a combination of electrostatic and magnetic lenses could also be used. For example, the condenser lens could be electrostatic and the objective lens could be magnetic, or both lenses could be electrostatic lenses. It is also clear that a sealed microfocus X-ray tube could be used instead of the continuously-pumped electron beam column and its replaceable target assembly.

Window 32 allows for operation of the electron beam column at a different pressure than the pressure in the housing 1. This makes it possible to align the diffractors with the X-ray source in operation. For this purpose, an alignment access port 35 shown with dashed lines is provided in the front wall of housing 1. After alignment, the diffractors may still be operated in a different environment than the electron beam in order to reduce the absorption of soft x-rays. For example housing 1 could be filled with helium at atmospheric pressure, or it could be pumped to a low vacuum (i.e. 20–50$\mu$). If a low vacuum is used in housing 1, window 32 may be removed if the objective lens is provided with a differential pumping aperture (not shown). Port 33 provides for evacuating or back-filling housing 1, and gate valve 34 may be used to isolate the sample stage assembly in order to change specimens without raising the pressure in chamber 1 to atmospheric pressure.

Additional details on the electron beam column and the housing 1 are shown in FIG. 4 which shows a right side view along section A—A of FIG. 3. Extending to the rear are the high voltage cable 35 for the electron gun, a pumping tube 36 to evacuate the electron beam column and electrical connections 37 for the lenses.

Aperture rod 27 is preferably provided with several apertures 38 which can be selectively used to obtain different electron beam spot sizes with optimum current. Target holder block 29 and target holder 31 are electrically insulated from the housing and connected by means of a wire 39 to a feed-through 40. This allows the target current to be monitored and also to be used as a signal for obtaining scanning images of the targets. The EDS detector 13 and detector collimator 13*a* are shown in FIG. 4 in the position for normal operation while they are shown in a retracted position required for use of the optical viewing system in FIG. 3. A bellows 41 allows the movement of the detector without changing the environment in the housing 1 as is commonly done with EDS detectors used in scanning electron microscopes. Other components in FIG. 4 are as previously identified on FIG. 3.

The crystalline materials used for the diffractors may be any of those commonly used for X-ray spectrometry. An excellent summary of the crystals that are useful for stellar X-ray astronomy was published by N. G. Alexandropoulos (Applied Spectroscopy, vol. 28, pp 155–64, 1974). Some of the commonly available crystals that can be elastically bent include TAP (thallium acid phthalate), EDdT (ethylene diamine d-tartrate), PET (pentaerythritol), quartz, mica, and silicon. FIG. 5 shows the parameters for diffractors that could be used in a microprobe X-ray fluorescence analysis system for 8 different photon energies ranging from slightly less than 1 keV to over 17 keV. A useful combination of diffractors that would allow up to 5 diffractors to be located in the same instrument are indicated by cases 1, 6, 12, 15, and 19. The use of these five characteristic lines and diffractors would require only three targets, namely, copper, titanium and molybdenum since both the K and L lines of copper and molybdenum can be used. This combination of diffractors provides photon energies of 0.928, 2.295, 4.510, 8.047 and 17.478 keV. Another combination of diffractors could be cases 3, 4, 12, 16, and 18. This would provide photon energies of 1.487, 2.166, 4.510, 8.047 and 16.614 keV. Obviously many other possibilities exist for diffractors and characteristic lines and the ones given in FIG. 5 should be considered only as representative examples.

It should be noted that a good coverage of elements in the periodic table can be obtained by the used of only three diffractors, for example using only the copper K line and the molybdenum K and L lines. The addition of the copper L line or the aluminum K line enhances the detection of very light elements, e.g. carbon, oxygen and nitrogen, while the use of the titanium K line enhances the detection of some of the elements of particular interest as dopants in semiconductor devices.

In FIG. 5, some typical diffractor dimensions, i.e. width w and height h, are given. The width is based on the width that would provide efficient use of the diffractor's surface if the rocking curve width is that of mica and the diffractor had the Johann geometry in the plane of the focal circle. The height is based on an azimuthal angle of 40 degrees subtended by the diffractor about the line joining the source and the image.

The diffractor dimensions shown in FIG. 5 should be considered as examples only since it is clear that a greater width could be used if the diffractor had the Johansson geometry or a stepped approximation to it in the plane of the focal circle. A greater height could also be used if the housing is large enough, since it is mainly limited only by the maximum practical azimuthal angle of about 120 degrees. However, it is probably more difficult to achieve higher intensities by increasing the diffractor height than by using higher electron beam voltages, since the intensity of characteristic X-ray lines is approximately proportional to the 1.65 power of the voltage above the critical excitation voltage and the electron beam source brightness increases with increasing accelerating voltage.

From FIGS. 3 and 4 it is apparent that the optical viewing system and the EDS detector interfere with each other when it is desired to have a high numerical aperture for the optical system and also a high collection efficiency of excited X-rays. This means that it is usually not possible to have simultaneous optical viewing while the X-ray analysis is performed. In order to make it more convenient to analyze multiple points on the specimen without requiring retraction of the X-ray detector between measurements, an image storage system is incorporated as part of the computer-controlled system for the specimen stage position. This is illustrated in FIG. 6.

Figure 6:
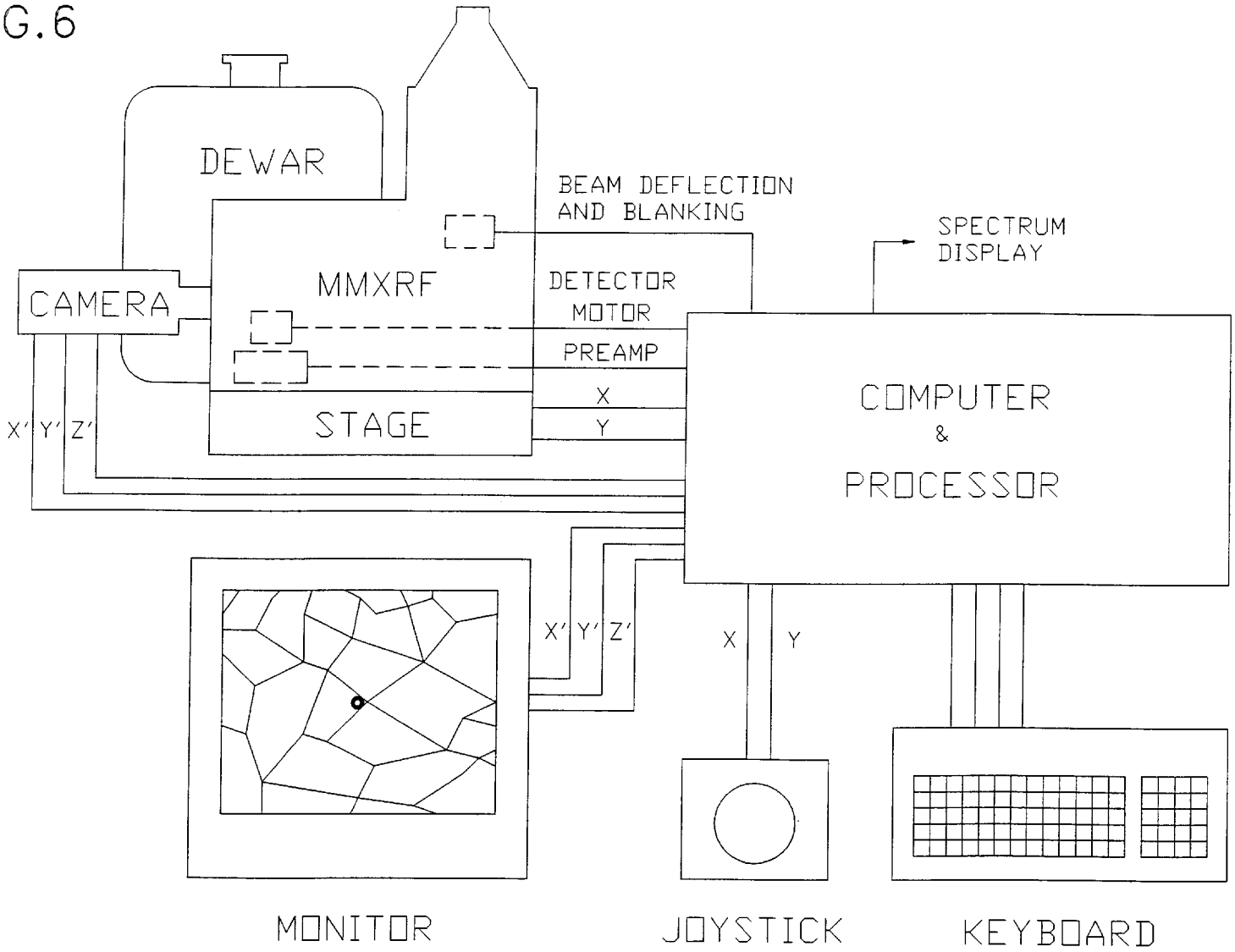
FIG. 6 shows an improved optical viewing system used in the instrument for microprobe X-ray fluorescence.

FIG. 6 shows optical signals from the video camera representing positions in the image and denoted by x' and y'. These signals go to a computer where these signals are stored along with the video signal z'. This image information is stored in the computer and processed according to the displacement of the stage represented by signals x and y which are controlled by the joystick. The stored image is then reproduced on the monitor with a displacement corresponding to the x and y positions of the stage. A cursor, represented by a bright-up region of the image and shown as a hollow disk on the monitor screen of FIG. 6, shows the position of the x-ray probe relative to the specimen's image. Alternatively, the cursor could move while the image remains stationary. In this way, the operator can make several measurements within the field of the stored image before the detector must be retracted. Each time the detector is retracted a new image is stored for use in a number of subsequent X-ray analyses. If the images and cursor position are stored by magnetic disk memory, this system also provides a permanent record of the points where the X-ray analysis was performed. Note that FIG. 6 also indicates that in the overall system the electron beam deflection and the motor driving the detector retraction mechanism could be under computer control as well as the stage positioning motors and enabling of the data readout.

Figure 7A:
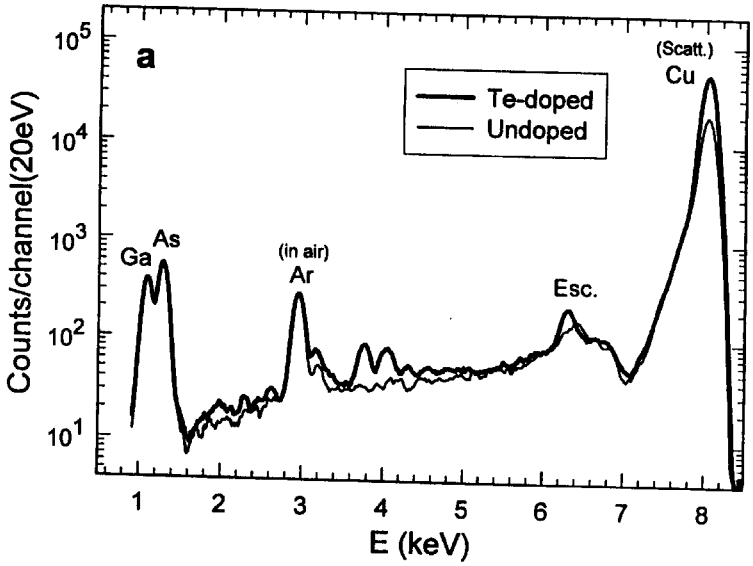
FIGS. 7*a*, 7*b*, and 7*c* show some typical results obtained with the instrument for microprobe X-ray fluorescence.
Figure 7B:
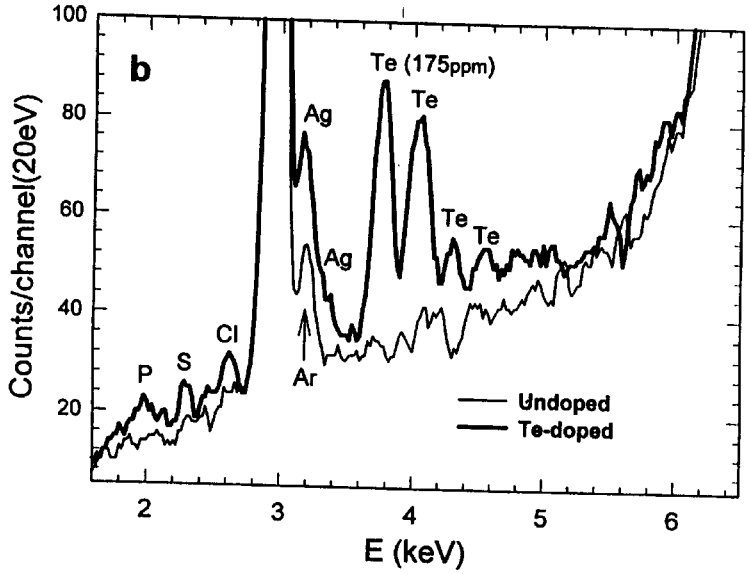
Figure 7C:
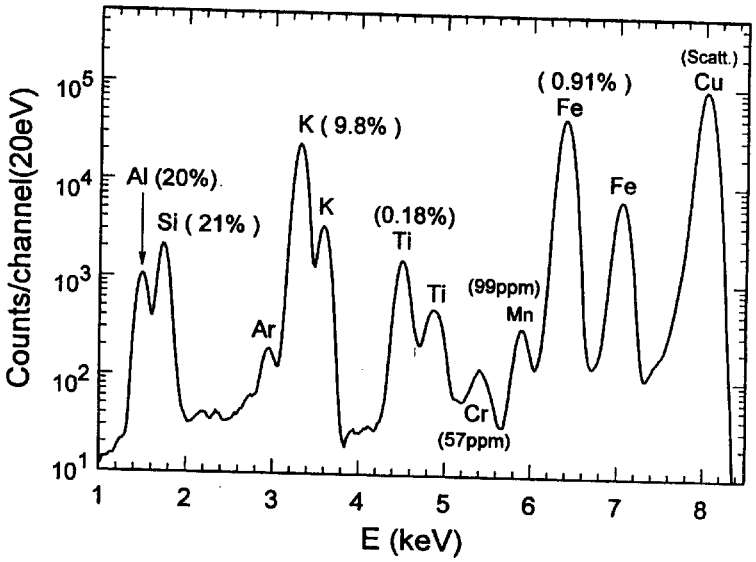

Some examples of spectra obtained with copper $K_\alpha$ radiation are shown in FIGS. 7*a*, 7*b*, and 7*c*. These spectra were recorded in 500 seconds with a mica diffractor 10 mm wide and 28 mm long using an electron beam operated at 30 kV and 3 watts (FIG. 7*a* and FIG. 7*b*) and 1.5 watts (FIG. 7*c*). FIG. 7*a* shows the spectra for two GaAs specimens with a log scale for the vertical axis and FIG. 7*b* shows the spectra from the same specimens with a linear scale for the vertical axis. FIG. 7*c* shows the spectrum of a muscovite specimen 40 $\mu$m thick. It can be seen that the efficiency of exciting elements in the specimen is highest for elements close to copper in atomic number and decreases considerably as their atomic number decreases significantly below that of copper. Thus, it is clear that the use of lower energy photons for excitation would result in improved detection of an element such as aluminum.

The advantage of using monochromatic excitation is shown in FIGS. 7*a*–7*c* by the exceptionally high signal-to-background ratio. This is 20–400 times higher than that typically obtained with EDS using electron beam or polychromatic X-ray excitation. The detection limit for an element present at a low concentration is inversely proportional to the signal-to-background ratio and these other methods of excitation typically provide detection limits of 0.1 weight percent. Thus, detection limits as low as a few parts per million can be obtained with monochromatic microprobe X-Ray fluorescence.

SUMMARY AND RAMIFICATIONS

The simplified system for local excitation by monochromatic radiation described in this invention is less costly to manufacture and simpler to align and use than other systems that provide excitation by selectable monochromatic radiation. It is expected to have a significant impact on the characterization of a wide variety of materials.

I claim:

1. A selectable X-ray monochromator comprising:

a plurality of X-ray sources located in proximity to each other;

means for selectively activating any one of said X-ray sources;

a plurality of diffracting crystal means wherein each diffracting crystal means has a preset position in space and is capable of focusing X-rays from the selected source to a common image location; and each diffracting means comprising toroidal crystal means which satisfies the Johann geometry within a plurality of planes containing the source and image location.

2. The monochromator of claim 1 wherein said preset position of each diffracting crystal means is accomplished by alignment means relative to the selected source and the common image location.

3. The monochromator of claim 2 wherein each of said plurality of diffracting crystal means is contained on a common mounting plate.

4. The monochromator of claim 1 wherein the x-rays are produced by bombardment of a target by a focused energetic electron beam and the electron beam is deflected by an electrostatic field for selecting a target to serve as said source of X-rays.

5. The monochromator of claim 1 wherein the x-rays are produced by bombardment of a target by a focused energetic electron beam and the electron beam is deflected by a magnetic field for selecting a target to serve as said source of X-rays.

6. The monochromator of claim 1 wherein the x-rays are produced by bombardment of a target by a focused energetic electron beam, the targets that serve as said x-ray sources are contained on a common target holder and selection of a particular target is done by motion of said target holder.

7. A selectable X-ray monochromator comprising:

a plurality of X-ray sources located in proximity to each other;

means for selectively activating any one of said X-ray sources;

a plurality of diffracting crystal means wherein each diffracting crystal means has a preset position in space and is capable of focusing X-rays from the selected source to a common image location; and each diffracting means comprising toroidal crystal means which satisfies the Johansson geometry within a plurality of planes containing the source and image location.

8. The monochromator of claim 7 wherein each diffracting crystal means can be individually aligned relative to the selected source and the common image location.

9. The monochromator of claim 8 wherein each of said plurality of diffracting crystal means is contained on a common mounting plate.

10. The monochromator of claim 7 wherein the x-rays are produced by bombardment of a target by a focused energetic electron beam and the electron beam is deflected by an electrostatic field to select a target to serve as said source of X-rays.

11. The monochromator of claim 7 wherein the x-rays are produced by bombardment of a target by a focused energetic electron beam and the electron beam is deflected by a magnetic field to select a target to serve as said source of X-rays.

12. The monochromator of claim 7 wherein the x-rays are produced by bombardment of a target by a focused energetic electron beam, the targets that serve as said x-ray sources are contained on a common target holder, and selection of a particular target is done by motion of said target holder.

13. Apparatus for X-ray microanalysis comprising:

a plurality of X-ray sources each of which is capable of emitting characteristic photon energies;

a plurality of diffracting crystal means each of which has a preset position in space and is capable of focusing radiation from one of the said sources onto a sample at a common image position;

means of selectively activating one of said sources to produce radiation that is focused by one of said diffracting crystal means; and means for detecting and analyzing fluorescence X-rays emitted by the said sample.

14. The monochromator of claim 13 wherein said preset position of each diffracting crystal means is accomplished by alignment means relative to the selected source and the common image location.

15. Apparatus of claim 13 wherein the activation of said source is done by deflection of the focal spot of a focused energetic electron beam onto an appropriate target by means of an electric field.

16. Apparatus of claim 13 wherein the activation of said source is done by deflection of the focal spot of a focused energetic electron beam onto an appropriate target by means of a magnetic field.

17. Apparatus of claim 13 wherein the activation of said source is done by movement of a holder which contains electron beam targets, each target becoming an x-ray source when bombarded by a stationary focused energetic electron beam.

18. Apparatus of claim 13 which further comprises:

means for viewing the sample before X-ray fluorescence analysis; and means for adjusting the location on the sample at which X-ray fluorescence occurs.

19. Apparatus of claim 18 wherein means for adjusting the location on the sample at which X-ray fluorescence occurs consists of an x-y table means.

20. Apparatus of claim 19 wherein a storage means is provided for retaining images formed by said viewing means, stored images can be retrieved and presented on a display means, and the display contains a cursor that shows the position of the region analyzed relative to the sample's image.

* * * * *